US006251254B1

(12) United States Patent
Katoh et al.

(10) Patent No.: US 6,251,254 B1
(45) Date of Patent: Jun. 26, 2001

(54) ELECTRODE FOR CHROMIUM PLATING

(75) Inventors: Masaaki Katoh; Miwako Nara; Yukiei Matsumoto; Setsuro Ogata, all of Kanagawa (JP)

(73) Assignee: Permelec Electrode Ltd., Kanagawa (JP)

( * ) Notice: Subject to any disclaimer, the term of this patent is extended or adjusted under 35 U.S.C. 154(b) by 0 days.

(21) Appl. No.: 09/406,785

(22) Filed: Sep. 28, 1999

(30) Foreign Application Priority Data

Sep. 30, 1998 (JP) ..... 10-278221

(51) Int. Cl.[7] ..... C25D 3/06

(52) U.S. Cl. ..... 205/287; 205/284; 205/288; 205/289; 204/290.01; 204/290.03; 204/290.06; 204/290.08; 204/290.09; 204/290.12; 204/290.13; 204/290.14

(58) Field of Search ..... 204/290.01, 290.03, 204/290.06, 290.08, 290.09, 290.12, 290.13, 290.14; 205/284, 287, 288, 289

(56) References Cited

U.S. PATENT DOCUMENTS 5,098,546 * 3/1992 Kawashima et al. ..... 204/290.12
5,560,815 * 10/1996 Sekimoto et al. ..... 205/287

FOREIGN PATENT DOCUMENTS

| | | |
|---|---|---|
| 0 027 051 | 4/1981 | (EP) . |
| 0 531 264 A2 | 3/1993 | (EP) . |
| 0 538 955 A1 | 4/1993 | (EP) . |
| 2 015 032 | 9/1979 | (GB) . |
| 2 290 553 | 1/1996 | (GB) . |

OTHER PUBLICATIONS

JP 9053200—Abstract (3 pages) Feb. 25, 1997.
British Search Report.

* cited by examiner

*Primary Examiner*—Bruce F. Bell
(74) *Attorney, Agent, or Firm*—Sughrue, Mion, Zinn, Macpeak & Seas, PLLC

(57) ABSTRACT

An electrode adapted for chromium plating from trivalent chromium baths which comprises a conductive base, an electrode material layer comprising iridium oxide formed thereon, and a porous layer formed on the surface of the electrode material layer. The porous can comprise an oxide containing at least one element selected from the group consisting of silicon, molybdenum, titanium, tantalum, zirconium, and tungsten. Use of this electrode for chromium plating reduces the oxidation of trivalent chromium into hexavalent chromium.

11 Claims, No Drawings

ELECTRODE FOR CHROMIUM PLATING

FIELD OF THE INVENTION

The present invention relates to an electrode for use in chromium plating. More particularly, this invention relates to an anode which is suitable for use in chromium plating from trivalent chromium baths and is effective in diminishing the oxidation of trivalent chromium to hexavalent chromium.

BACKGROUND OF THE INVENTION

Chromium plating is widely used for the corrosion protection of iron-based metals, decoration, etc. Although plating baths containing chromic acid, which is a compound of hexavalent chromium, as a chromium material have been used for chromium plating, the discharge of hexavalent chromium into the environment is strictly restricted because of the problem of environmental pollution. Attention is hence directed to a plating method in which trivalent chromium, which is less toxic, is used as a feed material in place of hexavalent chromium.

Theoretically, the plating method in which trivalent chromium is used as a feed material is capable of depositing the metal at a rate two times that in plating from a hexavalent chromium bath at the same plating current. This plating method is characterized in that it is excellent in covering power, throwing power, etc., and that wastewater treatment is easy. However, it has problems, for example, in that electrode reactions including the anodic oxidation of trivalent chromium into hexavalent chromium shorten the life of the plating bath and reduce the deposit quality. In the case where a metal electrode made of lead, a lead alloy, or the like is used as an anode for plating from a trivalent chromium bath, a sludge generates which is the same as the lead compound sludge resulting from dissolution of the lead electrode used in plating from hexavalent chromium baths. In addition, the lead oxide yielded on the anode surface accelerates the oxidation of trivalent chromium to enhance the generation of hexavalent chromium. Thus, the problems inherent in hexavalent chromium have remained unsolved.

JP-B-56-43119 (the term "JP-B" as used herein means an "examined Japanese patent publication") proposes to prevent the anodic generation of hexavalent chromium by using, for plating from a trivalent chromium bath, an anode comprising at least one of iron, iron alloys, nickel, nickel alloys and nickel oxide. JP-B-61-22037 proposes the use of a ferrite electrode. However, use of these electrodes as an anode has a problem in that an electrode component contained in the anode dissolves away to generate a sludge or adhere to the surface of the work, resulting in a decrease in deposit quality.

JP-A-54-134038 (the term "JP-A" as used herein means an "unexamined published Japanese patent application"), JP-A-61-23783, and JP-A-61-26797 disclose a plating technique in which an ion-exchange membrane is used to partition an electrolytic cell into an anode chamber and a cathode chamber. In this technique, an aqueous solution of a salt of trivalent chromium is fed to the cathode chamber, while a solution not containing trivalent chromium, e.g., a solution of an acid containing the same anion as the salt of trivalent chromium, is fed to the anode chamber.

When the solution to be fed to the anode chamber is a sulfuric acid solution, the anode is, for example, an electrode comprising a lead or titanium base coated with either a noble metal or an oxide thereof. When the solution to be fed to the anode chamber is a chloride solution, the anode is, for example, an electrode comprising a graphite or titanium base coated with either a noble metal or an oxide thereof. However, this technique has a problem in that the plating vessel has a complicated structure due to the use of an ion-exchange membrane.

Furthermore, JP-A-8-13199 discloses the use of an electrode comprising an electrode base coated with an electrode catalyst comprising iridium oxide as an anode in a trivalent chromium bath. Use of iridium oxide as an electrode catalyst is effective in attaining improvements including a prolonged electrode life. However, it has been found that the bath becomes unstable through long-term use due to the hexavalent chromium ions which generate in a slight amount and due to the decomposition products resulting from the electrolytic oxidation of an organic additive contained in the bath. There is hence a need for an electrode with which the bath components are stable over a long period of operation and the generation of hexavalent chromium is further diminished.

SUMMARY OF THE INVENTION

It is therefore an object of the present invention to provide a method of chromium plating from trivalent chromium baths which minimizes the generation of hexavalent chromium in anodic reactions, keeps the plating bath components stable over a long period of operation, and exerts a limited influence on the environment.

The above object of the present invention has been achieved by providing an electrode for chromium plating from a trivalent chromium bath which comprises a conductive base, an electrode material layer comprising iridium oxide formed on the base, and a porous layer formed on the surface of the electrode material layer.

In a preferred embodiment, the porous layer is made of an oxide containing at least one element selected from the group consisting of silicon, molybdenum, titanium, tantalum, zirconium and tungsten.

DETAILED DESCRIPTION OF THE INVENTION

The present invention has been completed based on the finding that an electrode constituted by forming a porous layer on an electrode material layer formed on a conductive base functions as an anode for chromium plating from trivalent chromium baths, and is effective in preventing the oxidation reaction in which trivalent chromium present in the plating baths is oxidized to hexavalent chromium.

The characteristic feature of the electrode for chromium plating of the present invention resides in that it has a porous layer on the electrode catalyst layer.

The porous layer can be made of an oxide containing at least one element selected from silicon, molybdenum, titanium, tantalum, zirconium and tungsten. Examples of the oxide include $SiO_2$, $TiO_2$, $Ta_2O_5$, $ZrO_2$ and $WO_3$.

Of these, $SiO_2$, $TiO_2$, and $ZrO_2$ are preferred.

The porous layer preferably covers the surface of the electrode material layer in a thickness of from 2 to 50 $\mu$m. The thickness of the porous layer is more preferably from 5 to 20 $\mu$m. It is, however, necessary that the electrode material layer be completely covered with the porous layer even when examined with an electron microscope.

For forming the porous layer, the following methods can be used. First, a sol is prepared by the sol-gel method from, e.g., an alkyl compound containing a material for porous-layer formation such as an organosilicon compound. At least one of phosphorus pentoxide, phosphoric acid and boric acid is added to the sol, and the resultant fluid is applied to the surface of an electrode. The coating is burned to form a layer. Thereafter, the phosphorus pentoxide, phosphoric acid and boric acid are dissolved away with warm water or the like to form the target porous layer. Other usable methods include: a method which comprises applying an aqueous solution of a compound for porous-layer formation such as sodium silicate on the surface of an electrode, burning the coating, and then dissolving away the resultant soluble ingredient with warm water or the like; and a pyrolytic method in which a solution of a salt for porous-layer formation, e.g., titanium chloride, zirconium chloride, molybdenum chloride or tantalum chloride is applied, and the resultant coating is pyrolyzed to form a porous oxide film.

Still another method usable for obtaining the desired porous layer comprises adding a sodium salt, phosphoric acid, or boric acid to a material for porous-layer formation, forming a layer through burning, and then dissolving away the added substance with warm water or the like.

The conductive base for use as an electrode base in the present invention is preferably made of a highly corrosion-resistant metal capable of forming a thin film, such as, eg., titanium, tantalum or niobium.

The conductive base may be a plate or a perforated plate obtained by forming many perforations in a plate, or may be an expanded metal or the like.

In forming an electrode material layer on a conductive base such as, e.g., titanium, the electrode base is preferably cleaned and then pickled to thereby activate the base surface and simultaneously increase the surface area. Namely, the base surface is treated so as to improve the adhesion strength of the coating layer. A physical means such as, e.g., sand-blasting may be used for increasing the surface area of the electrode base.

The pickling is accomplished, for example, by immersing the electrode base in 20 wt % boiling hydrochloric acid for about from 10 to 20 minutes. In the case of using sulfuric acid as a pickling solution, the electrode base is desirably treated by immersion in 35 wt % sulfuric acid at 80 to 95° C. for about from 1 to 3 hours. In the case of oxalic acid, the electrode base is desirably treated by immersion in a saturated oxalic acid solution at 95° C. for about from 3 to 10 hours.

After the surface of the electrode base is thus activated, an electrode material layer is formed thereon. However, prior to forming an electrode material layer, an interlayer is preferably formed on the electrode base. This interlayer comprises at least one of metals such as titanium, tantalum, niobium, zirconium, molybdenum, tungsten, tin, antimony, platinum, and the like and oxides of these metals. The formation of such an interlayer enables the production of an electrode having higher durability than those having no interlayer. In particular, the interlayer is effective in preventing the conductive base from being passivated by the anodic generation of oxygen.

The electrode material layer preferably contains, besides iridium oxide, at least one member selected from metallic titanium, tantalum, niobium, zirconium, tin, antimony, ruthenium, platinum, cobalt, molybdenum, and tungsten and oxides of these metals. The proportion of iridium oxide in the electrode catalyst is preferably from 30 to 90% by mole. Since electrode catalysts consisting of iridium oxide alone are slightly inferior in durability, it is preferred to employ a composition which further contains one or more of the aforementioned metals and metal oxides. An especially preferred electrode material layer comprises iridium oxide and tantalum oxide. The deposition amount of the electrode material layer is preferably from 5 to 80 g/m$^2$ in terms of the amount of iridium metal.

The electrode material layer comprising iridium oxide can be formed by a method in which a solution containing a salt or other compound of iridium, serving as a constituent metal of the electrode material, is applied on a conductive base and the coating is pyrolyzed by heating in an oxygen-containing atmosphere. Alternatively, use can be made of sputtering, vapor deposition, plasma spraying, or the like. It is, however, preferred to form an electrode material layer by dissolving a mixture consisting of two or more of metal chlorides and organometallic salts in a given proportion in hydrochloric acid, butanol, isopropanol, or the like, applying the resultant solution to a conductive base, and then baking the coating in an oxygen-containing atmosphere.

The electrode for chromium plating of the present invention is considered to function by the following mechanism. The porous layer formed on the electrode surface inhibits chromium ions from diffusing to the surface of the electrode material and causes an oxygen-generating reaction to proceed, whereby the oxidation of trivalent chromium into hexavalent chromium can be inhibited. Consequently, besides being suitable for use in chromium plating, the electrode of the present invention is applicable to reactions for oxidizing metal ions and to electrolytic reactions in which the oxidation of chlorine ions, having a large ionic radius, should be inhibited so as to selectively conduct oxygen generation.

The present invention will be explained below in more detail by reference to the following Examples, but the invention should not be construed as being limited thereto.

EXAMPLE 1

A 20 mm-square titanium plate as a conductive base was pickled with hot oxalic acid. A solution of iridium chloride and tantalum chloride wherein the proportion of iridium to tantalum had been regulated to 6:4 by weight was applied to both sides of the pickled base with a brush, and the resultant coating was burned at 500° C. in air. This coating/burning operation was repeated to form, after the final burning, an electrode material layer containing iridium oxide in an amount of 10 g/m$^2$.

Subsequently, a coating fluid was prepared by mixing silicon orthotetraethoxide, phosphorus pentoxide, ethanol, and water so that the proportion of silicon to phosphorus to ethanol to water was 1:1:10:5 by mole. The coating fluid was applied on the electrode material layer and the resultant coating was burned at 500° C. for 10 minutes This coating/burning operation was repeated, and the coated base was then shaken in 80° C. ion-exchanged water to remove a soluble ingredient therefrom. Thus, electrodes 1 to 3 were produced as samples in which the thickness of the porous layer varied from 3 to 17 $\mu$m.

These sample electrodes, which each had a porous layer, and a comparative electrode not having a porous layer were subjected to a plating test in which the degree of generation of hexavalent chromium in a trivalent chromium plating bath was determined. The degree of generation of hexavalent chromium means the proportion of the hexavalent chromium which was generated in the electrolysis to the trivalent chromium which was added initially.

The test was conducted in the following manner. An electrolytic cell partitioned with a diaphragm (Nafion 117, manufactured by E.I. du Pont de Nemours & Co.) was used. The anode chamber was filled with a sulfuric acid solution having a sulfuric acid concentration of 50 g/l and containing trivalent chromium dissolved therein in a concentration of 10 g/l, while the cathode chamber was filled with a sulfuric acid solution having a sulfuric acid concentration of 50 g/l. A copper rod was used as a cathode. The above prepared sample electrodes were respectively used as an anode. Electrolysis was conducted under conditions of a current density of 10 A/dm$^2$, an electrolyte temperature of 50° C., and an electrolysis time of 8 hours to determine the degree of generation of hexavalent chromium. The results obtained are shown in Table 1. The results show that the greater the thickness of the porous layer, the lower the degree of generation of hexavalent chromium.

EXAMPLE 2

The same procedure as in Example 1 was carried out, except that triethoxyvinylsilane was used as a silicon material. Thus, electrode 4 was produced which had an $SiO_2$ layer having a thickness of 5 $\mu$m.

Furthermore, electrode 5 which had an $SiO_2$ layer having a thickness of 5 $\mu$m was produced in the same manner as above except for the following. A commercial sodium silicate solution was diluted with an equivolume amount of water. The diluted solution was applied and the resultant coating was burned at 500° C. This coating/burning operation was repeated, and the coated base was then rinsed with 80° C. hot water to obtain the electrode. Electrodes 4 and 5 were evaluated with respect to the degree of generation of hexavalent chromium in the same manner as in Example 1. The results obtained are shown in Table 1.

EXAMPLE 3

Coating fluids were prepared by separately dissolving zirconium chloride, titanium chloride, and tantalum chloride in hydrochloric acid having a concentration of 10% by weight. The coating fluids were separately applied on the electrode material layer with a brush, and each resultant coating was burned at 500° C. for 20 minutes. Thus, electrodes 6 to 8 were produced which respectively had 5 $\mu$m-thick porous layers of the metal oxides. These electrodes were evaluated with respect to the degree of generation of hexavalent chromium in the same manner as in Example 1. The results obtained are shown in Table 1.

TABLE 1

| | Coating thickness ($\mu$m) | Degree of generation of hexavalent chromium (%) |
|---|---|---|
| Comparative electrode | 0 | 1.6 |
| Electrode 1 | 3 | 0.7 |
| Electrode 2 | 10 | 0.5 |
| Electrode 3 | 17 | 0.3 |
| Electrode 4 | 5 | 0.1 |
| Electrode 5 | 5 | 0.05 |
| Electrode 6 | 5 | 0.2 |
| Electrode 7 | 5 | 0.1 |
| Electrode 8 | 5 | 0.3 |

Since the electrode for chromium plating of the present invention has a porous layer formed on the surface of an electrode material layer, the generation of hexavalent chromium due to the oxidation of trivalent chromium is diminished when the electrode is used as an anode for chromium plating from a trivalent chromium bath. Consequently, the trivalent chromium bath can have a prolonged life and stable plating is possible. Furthermore, the anode need not be separated with an ion-exchange membrane and the plating operation is easy.

While the invention has been described in detail and with reference to specific embodiments thereof, it will be apparent to one skilled in the art that various changes and modifications can be made therein without departing from the spirit and scope thereof.

What is claimed is:

1. An electrode for chromium plating from trivalent chromium baths which comprises a conductive base, an electrode material layer comprising iridium oxide formed on the base, and a porous layer formed on the surface of the electrode material layer consisting of an oxide of one or more elements selected from the group consisting of silicon, molybdenum, titanium, tantalum, zirconium and tungsten.

2. The electrode for chromium plating of claim 1, wherein the porous layer completely covers the electrode material layer.

3. The electrode for chromium plating of claim 1, wherein said porous layer has a thickness of from 2 to 50 $\mu$m.

4. The electrode for chromium plating of claim 1, wherein said porous layer has a thickness of from 5 to 20 $\mu$m.

5. The electrode for chromium plating of claim 1, wherein said porous layer completely covers the electrode material layer.

6. The electrode for chromium plating of claim 1, wherein said conductive base comprises a metal selected from the group consisting of titanium, tantalum and niobium.

7. The electrode for chromium plating of claim 1, wherein said electrode material layer comprises iridium oxide and at least one member selected from the group consisting of metallic titanium, tantalum, niobium, zirconium, tin, antimony, ruthenium, platinum, cobalt, molybdenum, tungsten and oxides thereof.

8. The electrode for chromium plating of claim 7, wherein the proportion of iridium oxide in the electrode material layer is from 30 to 90 mol %.

9. The electrode for chromium plating of claim 1, wherein said electrode material layer is formed on the base in a coverage of 5 to 80 g/m$^2$ in terms of iridium metal.

10. A method for plating chromium onto a substrate, which comprises passing an electric current through a plating bath including a trivalent chromium solution, and anode and a cathode, wherein said substrate which serves as the cathode is dipped into said trivalent chromium solution and said anode comprises a conductive base, an electrode material layer comprising iridium oxide formed on the base, and a porous layer formed on the surface of the electrode material layer consisting of an oxide of one or more elements selected from the group consisting of silicon, molybdenum, titanium, tantalum, zirconium and tungsten.

11. The method for plating chromium onto a substrate of claim 10, wherein the porous layer completely covers the electrode material layer.

* * * * *